United States Patent [19]

Mukunoki et al.

[11] Patent Number: 4,649,102

[45] Date of Patent: Mar. 10, 1987

[54] SILVER HALIDE PHOTOGRAPHIC LIGHT-SENSITIVE MATERIAL

[75] Inventors: Yasuo Mukunoki; Shigeki Yokoyama; Hiroshi Kawasaki; Ryoichi Nemori, all of Kanagawa; Tetsuo Takeuchi, Shizuoka, all of Japan

[73] Assignee: Fuji Photo Film Co., Ltd., Kanagawa, Japan

[21] Appl. No.: 817,648

[22] Filed: Jan. 10, 1986

Related U.S. Application Data

[63] Continuation-in-part of Ser. No. 657,280, Oct. 3, 1984, abandoned.

[30] Foreign Application Priority Data

Oct. 3, 1983 [JP] Japan ..... 58-184727
Oct. 3, 1983 [JP] Japan ..... 58-184728

[51] Int. Cl.[4] ..... G03C 1/94

[52] U.S. Cl. ..... 430/527; 430/528; 430/631; 430/637

[58] Field of Search ..... 430/527, 528, 631, 637

[56] References Cited

U.S. PATENT DOCUMENTS 3,850,641 11/1974 Horigome et al. ..... 430/527
4,510,233 9/1985 Yokoyama et al. ..... 430/527
4,518,354 5/1985 Yokoyama et al. ..... 430/527

*Primary Examiner*—Jack P. Brammer
*Attorney, Agent, or Firm*—Sughrue, Mion, Zinn, Macpeak, and Seas

[57] ABSTRACT

A silver halide photographic light-sensitive material is described, comprising a support having provided thereon at least one silver halide emulsion layer, wherein there is at least one hydrophilic colloidal layer containing at least one nonionic surface active agent and at least one anionic surface active agent having a polyoxyethylene group therein.

12 Claims, No Drawings

SILVER HALIDE PHOTOGRAPHIC LIGHT-SENSITIVE MATERIAL

CROSS-REFERENCE TO RELATED APPLICATIONS

This is a continuation-in-part application of U.S. patent application Ser. No. 657,280, filed Oct. 3, 1984, now abandoned.

FIELD OF THE INVENTION

This invention relates to a silver halide photographic light-sensitive material (hereinafter also referred to more simply to as a light-sensitive material) having excellent antistatic property. More particularly, it relates to a silver halide photographic light-sensitive material including certain components which do not adversely affect photographic properties, and do not cause contamination of a developer, adhesion of water-insoluble matters onto carrying rollers, and other problems due to the water-insoluble matters such as uneven drying, film stains and the like during development processing using an automatic developing machine.

BACKGROUND OF THE INVENTION

Since photographic light-sensitive materials are generally composed of an electrically insulating support base (hereinafter also more simply referred to as the support) and photographic emulsion layers, it is frequently observed that friction therebetween or with other substances or peeling of the light-sensitive materials during the production or upon use induces accumulation of static charge. The accumulated static charge causes various problems, one of, and the most serious of which, is that the static electricity accumulated before development processing is discharged so as to expose the light-sensitive emulsion layers to light. When the light-exposed photographic film is subjected to development processing, dots or arborescent or feathery lines that are called static marks are formed on the photographic films, thus significantly impairing or sometimes completely destroying the commercial value of the film. For example, appearance of the static marks on X-ray films for medical or industrial use may lead to incorrect and dangerous judgment. This phenomenon, i.e., formation of static marks, is a very difficult problem, because it does not evidence itself until the film is developed. Accumulated static charge also causes other problems, such as adhesion of dust on film surfaces and difficulty in uniform coating.

Such static charge is easily accumulated during the production or use of photographic light-sensitive materials as described above. For example, static electrification results from (1) contact friction between a photographic film and rollers; (2) separation between a support surface and an emulsion surface during winding or re-winding of the film roll in the course of production; (3) separation between a base surface and an emulsion surface during winding of the final photographic film product; (4) contact and separation between the film and machinery parts or fluorescent-sensitized paper in an automatic photographic machine for X-ray films. Contact with wrapping materials also causes static electrification. The static marks on the photographic light-sensitive materials induced by the above-described accumulation of static charge become even more significant with an increase in the sensitivity of the photographic light-sensitive material or an increase of processing rates. In particular, recent developments improving the sensitivity of photographic light-sensitive materials and the speeds of coating, photographing, and automatic development processing and the like have subjected such light-sensitive materials to severe conditions, tending to result in more frequent occurrence of static marks.

A commercial product of X-ray films generally contains a number of X-ray films with papers inserted between the films so as not to contact individual films with each other. When the X-ray films are stored for a long period of time while contacting the paper, static marks are liable to occur on the film due to the decrease in static property of light-sensitive materials, even though the films just after production have sufficient antistatic property. Although the reason for decreasing the antistatic property with the passage of time has not been completely understood, it is highly probable that a certain type of nonionic surface active agents present on the surface of the light-sensitive materials is diffused or transferred to the paper during the storage. Thus, it is highly desirable to develop light-sensitive materials which substantially do not decrease their antistatic property during the storage while contacting with papers.

In order to eliminate these disturbances ascribed to static electricity, it is preferable to add an antistatic agent to the photographic light-sensitive materials. However, antistatic agents commonly employed in other fields cannot be applied as such to photographic light-sensitive materials because of various limitations inherent to photographic light-sensitive materials. In other words, antistatic agents employable for photographic light-sensitive materials are required to have various specific performances, such as that: they are required not only to exhibit an excellent antistatic property but also to have no adverse influence on photographic properties of the photographic light-sensitive materials such as sensitivity, fog, graininess, sharpness, etc., to have no adverse influence on film strength of the light-sensitive materials (i.e., not to make the film surface more susceptible to damages due to friction or scratches), to have no adverse influence on adhesion resistance of the light-sensitive materials (i.e., not to make the film surfaces stick to each other or to other substances), not to accelerate fatigue of processing solutions, not to contaminate carrying rollers, not to reduce an adhesive strength between layers constituting the photographic light-sensitive materials, and so on.

Another method for overcoming the above-described problems due to static electricity comprises increasing electric conductivity of the surface of the photographic light-sensitive materials, thereby dispersing the static electricity in a short period of time before the accumulated electric charge discharges with adverse effects.

For this purpose, many methods for increasing conductivity of the support base or various coating layers have been developed, and use of a variety of hydroscopic substances or water-soluble organic salts, certain kind of surface active agents or polymers, etc., have been attempted.

Of these, use of surface active agents is important for prevention of static electricity. Known surface active agents include, for example, anionic, betaine and cationic surface active agents described in U.S. Pat. Nos. 3,082,123, 3,201,151, 3,519,561 and 3,625,695, West German Patent Nos. 1,552,408 and 1,597,472, Japanese Patent Application (OPI) (Open to Public Inspection) Nos. 85826/74, 129623/78, 159223/79 and 19213/73 and Japanse Patent Publication Nos. 39312/71, 11567/74, 46755/76 and 14417/80, etc.

These known surface active agents, however, show specificity depending on the kind of the film supports or photographic compositions. For example, they afford good results to some specific film supports, photographic emulsion layers or other photographic layers, but are not at all effective on other film supports or photographic layers; or, although their antistatic property is excellent, they may adversely affect photographic properties, e.g., sensitivity, fog, graininess, sharpness, etc., or cause contamination of developing solutions and adhesion on rollers. Thus, it has been quite difficult to successfully apply such known substances to photographic light-sensitive materials.

Further, techniques for static charge prevention by the use of nonionic surface active agents are closely related to coating agents with which they are used in combination. Although some progress is certainly being made toward achieving the antistatic property per se, no consideration has been given to the prevention of contamination of developing solutions or carrying rollers, which can lead to serious disorders of photographic films.

For instance, Japanese Patent Publication No. 9610/76 is disclosed that an ethylene oxide-added polymer of a phenol-formalin condensate is excellent in antistatic property even when used in combination with various coating agents. However, this method still cannot overcome the problem due to contamination during development processing. In other words, according to this method, contamination of carrying rollers, which is believed to arise from dry attachment on the rollers, is significant, and gives rise to the problem of uneven film concentration.

Furthermore, Japanese Patent Application (OPI) No. 29715/78 describes a photographic light-sensitive material containing a specific anionic surface active agent and a polyoxyethylene-based nonionic surface active agent, but such a light-sensitive material cannot achieve elimination of film disorders due to contamination of developing solutions or carrying rollers such as were noted above.

Many of these conventional techniques for providing photographic light-sensitive materials with antistatic property result in good antistatic effect just after preparation of the light-sensitive materials, but the antistatic effect tends to decrease with the passage of time. For this reason, technique for providing long-lasting antistatic effect has long been demanded.

SUMMARY OF THE INVENTION

One object of this invention is to provide an antistatic silver halide photographic light-sensitive material which does not cause contamination of developing solutions or rollers.

Another object of this invention is to provide an antistatic silver halide photographic light-sensitive material which does not cause contamination of subsequently following light-sensitive materials during development processing.

A further object of this invention is to provide an antistatic silver halide photographic light-sensitive material which does not adversely affect photographic properties, such as sensitivity.

A still further object of this invention is to provide a silver halide photographic light-sensitive material which maintains its antistatic property unchanged with the passage of time after production thereof.

These objects of the present invention can be accomplished by a silver halide photographic light-sensitive material comprising a support having thereon at least one silver halide emulsion layer, wherein there is at least one hydrophilic colloidal layer containing at least one nonionic surface active agent and at least one anionic surface active agent having a polyoxyethylene group therein.

DETAILED DESCRIPTION OF THE INVENTION

According to the present invention, the "at least one hydrophilic colloidal layer" containing at least one nonionic surface active agent and at least one anionic surface active agent having a polyoxyethylene group therein can be the silver halide layer, another hydrophilic colloid layer, or said surface active agents can be incorporated in multiple layer.

The nonionic surface active agent which can be used in the present invention preferably includes compounds represented by the formulae (I-2) and (I-3), as described below.

The compounds of formula (I-2) are represented by

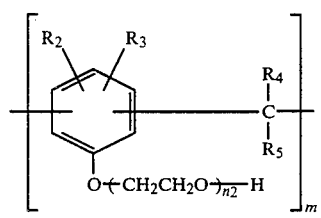

(I-2)

wherein $R_2$ and $R_3$ each represents a hydrogen atom, a substituted or unsubstituted alkyl group having from 1 to 30 carbon atoms, a substituted or unsubstituted aryl group having from 6 to 30 carbon atoms, or a substituted or unsubstituted alkoxy group having from 1 to 30 carbon atoms, an amide group, a sulfonamido group, a carbamoyl group, or a sulfamoyl group; $R_4$ and $R_5$ each represents a hydrogen atom, a substituted or unsubstituted alkyl group having from 1 to 30 carbon atoms or a substituted or unsubstituted aryl group having from 7 to 30 carbon atoms, provided that $R_4$ and $R_5$ are not hydrogen at the same time, or $R_4$ and $R_5$ together form a substituted or unsubstituted ring; $n_2$ represents an average degree of polymerization of ethylene oxide moiety ranging from 2 to 50; and m represents an average degree of polymerization ranging from 2 to 50.

The compounds of formula (I-3) are represented by

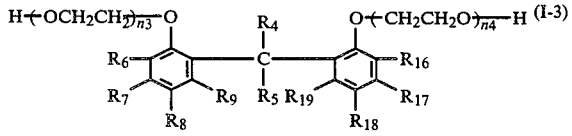

(I-3)

wherein $R_4$ and $R_5$ each represents a hydrogen atom, a substituted or unsubstituted alkyl group having from 1 to 30 carbon atoms or a substituted or unsubstituted aryl group having from 7 to 30 carbon atoms, or $R_4$ and $R_5$ together form a substituted or unsubstituted ring; $R_6$, $R_8$, $R_{16}$, and $R_{18}$ each represents a substituted or unsubstituted alkyl group having from 1 to 30 carbon atoms, a substituted or unsubstituted aryl group having from 6 to 30 carbon atoms, or a substituted or unsubstituted alkoxy group having from 1 to 30 carbon atoms, a halogen atom, an acyl group an amido group, a sulfonamido group, a carbamoyl group, or a sulfamoyl group; $R_7$, $R_9$, $R_{17}$ and $R_{19}$ each represents a hydrogen atom, a substituted or unsubstituted alkyl group having from 1 to 30 carbon atoms, a substituted or unsubstituted aryl group having from 6 to 30 carbon atoms or a substituted or unsubstituted alkoxy group having from 1 to 30 carbon atoms, a halogen atom, an acyl group, an amido group, a sulfonamido group, a carbamoyl group or a sulfamoyl group; or $R_6$ and $R_7$, $R_8$ and $R_9$, $R_{16}$ and $R_{17}$, or $R_{18}$ and $R_{19}$ together form a substituted or unsubstituted ring; and $n_3$ and $n_4$, which may be the same or different, each represents an average degree of polymerization of the ethylene oxide moiety ranging from 2 to 50.

The substituents on the phenyl rings may be unsymmetrical along the group

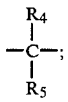

i.e., $R_6$ and $R_{16}$ are not necessarily the same, etc.

In the formula (I-2) and (I-3), $R_2$, $R_3$, $R_6$, $R_7$, $R_8$, and $R_9$ each preferably represents a substituted or unsubstituted alkyl group having from 1 to 20 carbon atoms, e.g., methyl, ethyl, i-propyl, t-butyl, t-amyl, t-hexyl, t-octyl, nonyl, decyl, dodecyl, trichloromethyl, tribromomethyl, 1-phenylethyl, 2-phenyl-2-propyl, etc., a substituted or unsubstituted aryl group, e.g., a phenyl group, a p-chlorophenyl group, etc., a substituted or unsubstituted alkoxy group of the formula $—OR_{11}$, wherein $R_{11}$ represents a substituted or unsubstituted alkyl group having from 1 to 20 carbon atoms or a substituted or unsubstituted aryl group (hereinafter the same), a halogen atom, e.g., a chlorine atom, a bromine atom, etc., an acyl group of the formula $—COR_{11}$, an amido group of the formula $—NR_{12}COR_{11}$, wherein $R_{12}$ represents a hydrogen atom or an alkyl group having 1 to 20 carbon atoms (hereinafter the same), a sulfonamido group of the formula $—R_{12}SO_2R_{11}$, a carbamoyl group of the formula

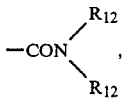

or a sulfamoyl group of the formula

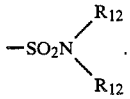

Further, $R_2$, $R_3$, $R_7$ and $R_9$ each preferably represents a hydrogen atom.

In the formula (I-3), it is more preferable that $R_6$ and $R_8$ each represents an alkyl group or a halogen atom, and particularly a bulky tertiary alkyl group, e.g., a t-butyl group, a t-amyl group, a t-octyl group, etc., and that $R_7$ and $R_9$ each represents a hydrogen atom. In other words, the compounds represented by formula (I-3) that are synthesized from 2,4-disubstituted phenols are particularly preferred.

In the formula (I-2), $R_4$ and $R_5$ preferably each represents a substituted or unsubstituted alkyl group, e.g., a methyl group, an ethyl group, an n-propyl group, an isopropyl group, an n-heptyl group, a 1-ethylamyl group, an n-undecyl group, a trichloromethyl group, a tribromomethyl group, etc., or a substituted or unsubstituted aryl group, e.g., an α-furyl group, a phenyl group, a naphthyl group, a p-chlorophenyl group, a p-methoxyphenyl group, a m-nitrophenyl group, etc. Further, a combination of $R_4$ and $R_5$, $R_6$ and $R_7$, or $R_7$ and $R_8$, when taken together forms a substituted or unsubstituted ring, e.g., a cyclohexyl ring. More preferably, $R_4$ and $R_5$ each represents an alkyl group having from 1 to 8 carbon atoms, a phenyl group, or a furyl group.

In the formula (I-3), $R_4$ and $R_5$ preferably each represents a hydrogen atom, a substituted or unsubstituted alkyl group, e.g., a methyl group, an ethyl group, an n-propyl group, an isopropyl group, an n-heptyl group, a 1-ethylamyl group, an n-undecyl group, a trichloromethyl group, a tribromomethyl group, etc., or a substituted or unsubstituted aryl group, e.g., an α-furyl group, a phenyl group, a naphthyl group, a p-chlorophenyl group, a p-methoxyphenyl group, a m-nitrophenyl group, etc. Further, a combination of $R_4$ and $R_5$, $R_6$ and $R_7$, or $R_7$ and $R_8$, when taken together, together forms a substituted or unsubstituted ring, e.g., a cyclohexyl ring. More preferbly, $R_4$ and $R_5$ each represents a hydrogen atom, an alkyl group having from 1 to 8 carbon atoms, a phenyl group, or a furyl group.

In the formulae (I-2) and (I-3), $n_2$, $n_3$, and $n_4$ preferably represents numbers of from 5 to 30.

Specific examples of compounds of formulae (I-2) and (I-3) are described, for example, in U.S. Pat. No. 2,982,651, 3,428,456, 3,457,076, 3,454,625, 3,552,972 and 3,655,387, Japanese Patent Publication No. 9610/76, Japanese Patent Application (OPI) Nos. 29715/78, 89626/79, 85764/82 and 90909/82, and in Hiroshi Sakaguchi, *Shin Kaimen Kasseizai, Sankyo Shuppan* (1975).

Specific examples of the nonionic surface active agents that are preferably used in the present invention are shown below. With respect to the compounds shown below, I-5 indicates that the "compound" is actually a mixture of compounds and the nonintegral subscripts means an average of the mixture.

| Compound No. | Chemical Formula |
|---|---|
| I-1 | 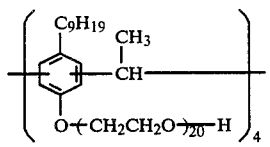 |
| I-2 | 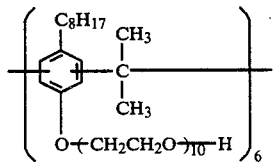 |

-continued
| Compound No. | Chemical Formula |
|---|---|
| I-3 | 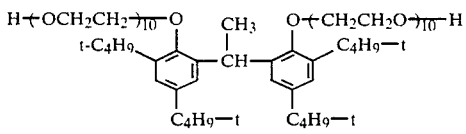 |
| I-4 | 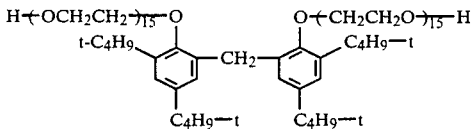 |
| I-5 | 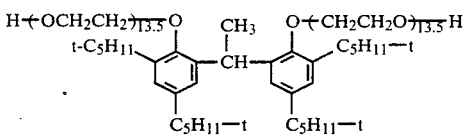 |
| I-6 | 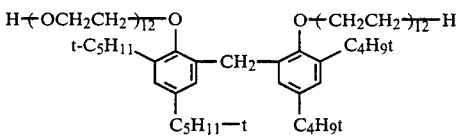 |
| I-7 | 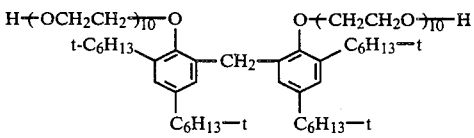 |
| I-8 | 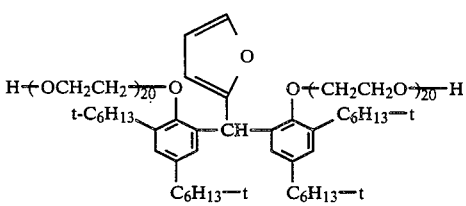 |
| I-9 | 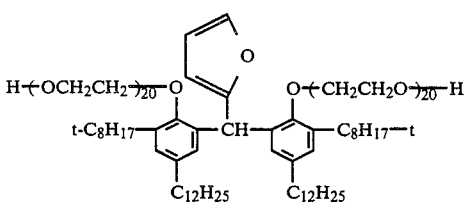 |
| I-10 | 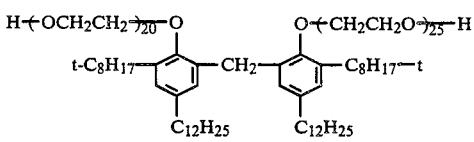 |
| I-11 | 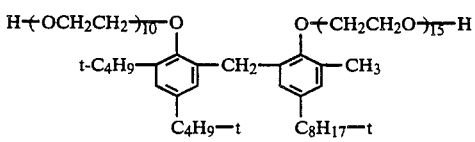 |
-continued
| Compound No. | Chemical Formula |
|---|---|
| I-12 | 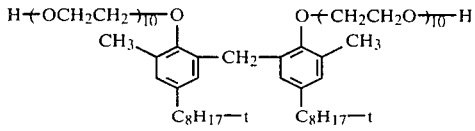 |
| I-13 | 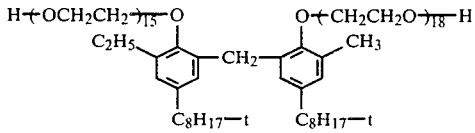 |
| I-14 | 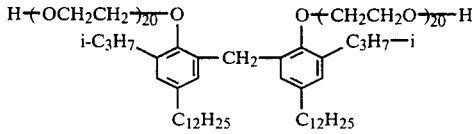 |
| I-15 | 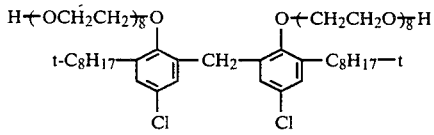 |
| I-16 | 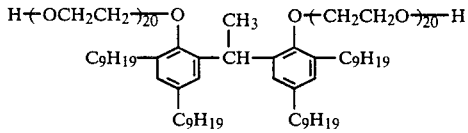 |
| I-17 | 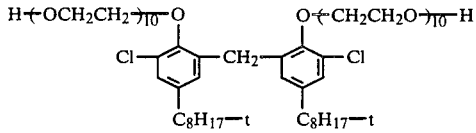 |
| I-18 | 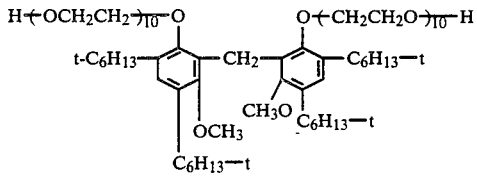 |
| I-19 | 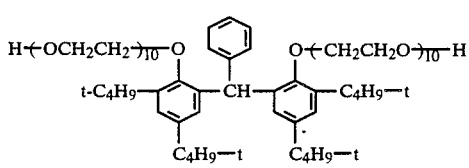 |
| I-20 | 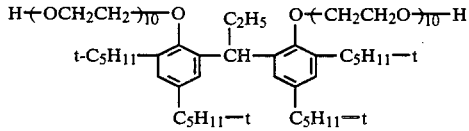 |
| I-21 | 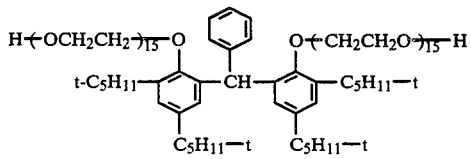 |

-continued
| Compound No. | Chemical Formula |
|---|---|
| I-22 | 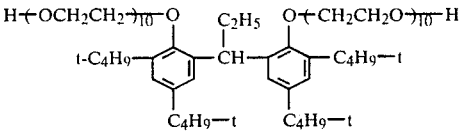 |
| I-23 | 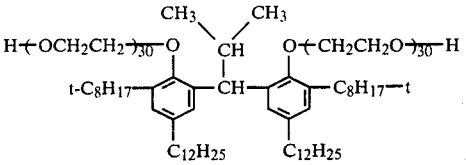 |
| I-24 | 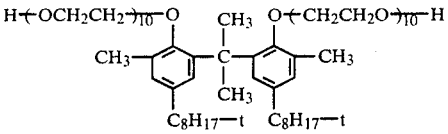 |
| I-25 | 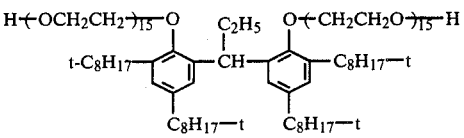 |
| I-26 | 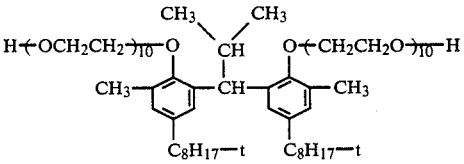 |
| I-27 | 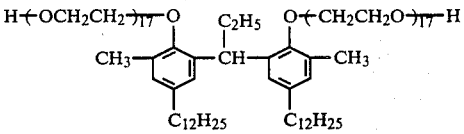 |
| I-28 | 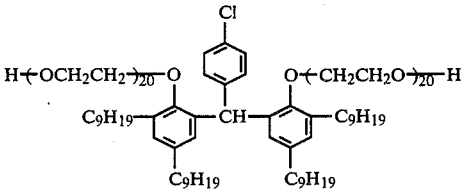 |
| I-29 | 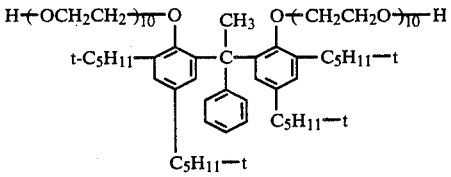 |
| I-30 | 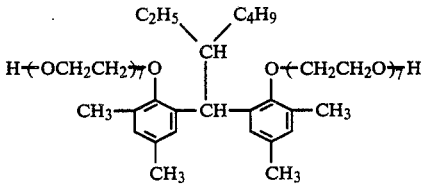 |
-continued
| Compound No. | Chemical Formula |
|---|---|
| I-31 | 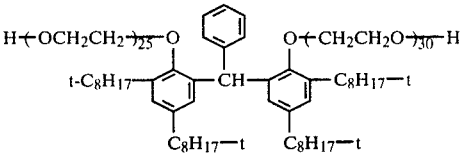 |
| I-32 | 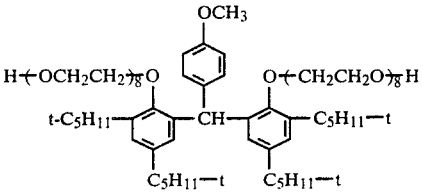 |
| I-33 | 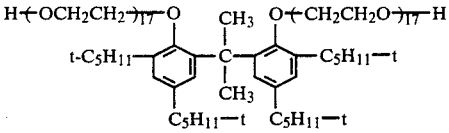 |
| I-34 | 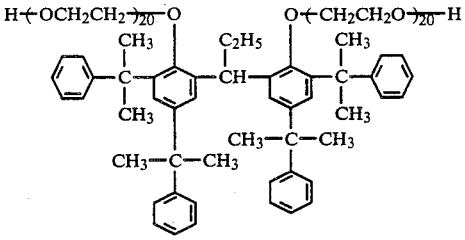 |
| I-35 | 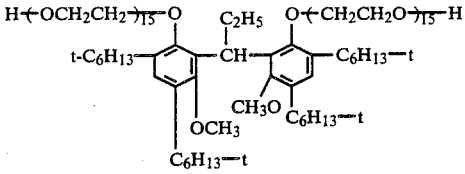 |
| I-36 | 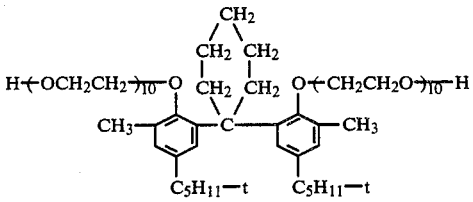 |
| I-37 | 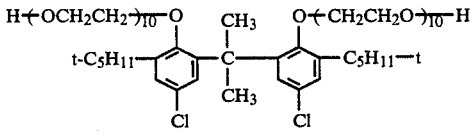 |
| I-38 | 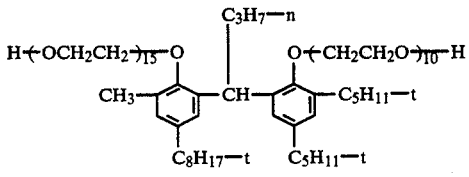 |

-continued

| Compound No. | Chemical Formula |
|---|---|
| I-39 | 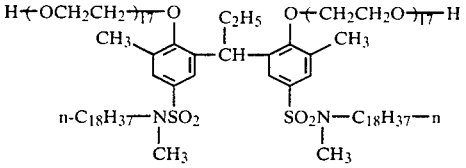 |
| I-40 | 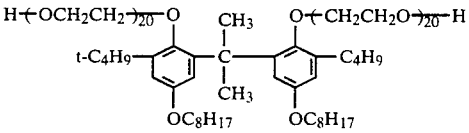 |
| I-41 | 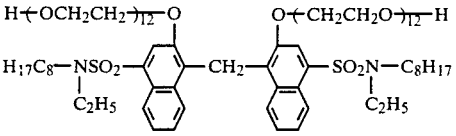 |
| I-42 | 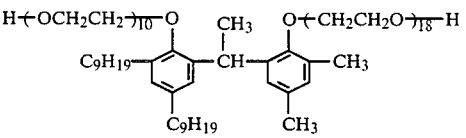 |

The anionic surface active agent having a polyoxyethylene group in its molecule that can be used in the present invention is preferably a compound represented by formula (II)

$$R_1—A—CH_2CH_2O)_{n5}B—D \quad (II)$$

wherein $R_1$ represents a substituted or unsubstituted alkyl group having from 1 to 30 carbon atoms, a substituted or unsubstituted alkenyl group having from 2 to 30 carbon atoms or a substituted or unsubstituted aryl group having from 6 to 30 carbon atoms; A represents $$—O—,\ —S—,\ —COO—,\ —\underset{|}{N}—R_{10},\ —CO—\underset{|}{N}—R_{10} \text{ or } —SO_2\underset{|}{N}—R_{10},$$

wherein $R_{10}$ represents a hydrogen atom or a substituted or unsubstituted alkyl group having from 1 to 30 carbon atoms; B represents a substituted or unsubstituted alkyl group having from 1 to 30 carbon atoms, a substituted or unsubstituted alkenyl group having from 2 to 30 carbon atoms or a substituted or unsubstituted aryl group having from 6 to 30 carbon atoms; D represents an anion group; and $n_5$ represents an average degree of polymerization ranging from 1 to 50.

In the above-described formula (II), $R_1$ preferably represents an alkyl group having from 4 to 24 carbon atoms, an alkenyl group having from 4 to 24 carbon atoms, or an alkylaryl group having from 7 to 24 carbon atoms, and more preferably is a hexyl group, a dodecyl group, an isostearyl group, an oleyl group, a t-butylphenyl group, a 2,4-di-t-butylphenyl group, a 2,4-di-t-pentylphenyl group, a p-dodecylphenyl group, a m-pentadecaphenyl group, a t-octylphenyl group, a 2,4-dinonylphenyl group or an octylnaphthyl group. $n_5$ preferably represents an integer of from 2 to 10. B preferably represents an alkylene group having from 1 to 6 carbon atoms, particularly a methylene group, an ethylene group, a propylene group, a butylene group, etc. D preferably represents $$—COOM,\ —SO_3M,\ —O—\overset{\overset{O}{\|}}{\underset{\underset{OM}{|}}{P}}—OM \text{ or}$$

$$—O—\overset{\overset{O}{\|}}{\underset{\underset{OM}{|}}{P}}—O—B(OCH_2CH_2)_{n5}—A—R_1,$$

wherein M represents an organic or inorganic cation, preferably a hydrogen atom, an alkali metal, an alkaline earth metal, ammonium ion, or a lower alkyl amino group.

Examples of compounds represented by the formula (II) are described in U.S. Pat. Nos. 3,026,202, 2,600,831, 2,719,087, 3,201,252 and 3,415,649, Japanese Patent Application (OPI) No. 98235/79, Japanese Patent Publication No. 23747/65, British Pat. Nos. 1,178,546 and 1,344,987 and U.S. Pat. Nos. 3,264,108 and 2,600,831, etc.

Specific examples of the anion surface active agents having a polyoxyethylene group which can be used according to the present invention are shown below. The compound II-12 is actually a mixture of compounds.

| Compound No. | Chemical Formula |
|---|---|
| II-1 | $C_8H_{17}O(CH_2CH_2O)_2(CH_2)_4SO_3Na$ |
| II-2 | $C_{12}H_{25}O(CH_2CH_2O)_4(CH_2)_4SO_3Na$ |
| II-3 | $C_{18}H_{35}O(CH_2CH_2O)_8(CH_2)_3SO_3Na$ |
| II-4 | $C_{12}H_{25}S(CH_2CH_2O)_3(CH_2)_4SO_3Na$ |
| II-5 | 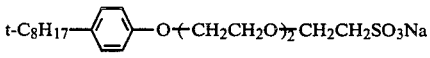 |
| II-6 | 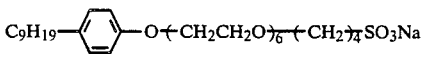 |
| II-7 | 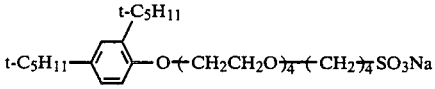 |
| II-8 | 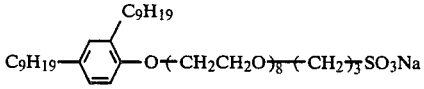 |
| II-9 | $C_{11}H_{23}CON(CH_2CH_2O)_2(CH_2)_4SO_3Na$ |
| II-10 | $C_9H_{19}O(CH_2CH_2O)_4SO_3K$ |
| II-11 | 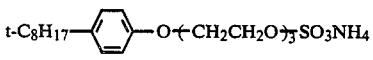 |
| II-12 | 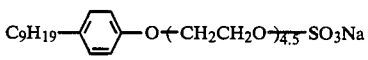 |

-continued

| Compound No. | Chemical Formula |
|---|---|
| II-13 | $C_{18}H_{35}O(CH_2CH_2O)_{14}SO_3Na$ |
| II-14 | $C_{15}H_{31}$–C$_6$H$_4$–$O(CH_2CH_2O)_8SO_3H.H_2NCH_2CH_2OH$ |
| II-15 | $C_{12}H_{25}O(CH_2CH_2O)_{14}CH_2COONa$ |
| II-16 | t-$C_8H_{17}$–C$_6$H$_4$–$O(CH_2CH_2O)_{14}CH_2COONa$ |
| II-17 | $C_{18}H_{35}O(CH_2CH_2O)_{14}P(=O)(ONa)_2$ |
| II-18 | $C_9H_{19}$–C$_6$H$_4$–$O(CH_2CH_2O)_{13}P(=O)(ONa)_2$ |

The amount of each of the surface active agents of the formulae (I-2), (I-3) and (II) to be used in the present invention may vary depending on the forms, types, and coating methods employed for photographic light-sensitive materials, but usually each of the surface active agents can be used in an amount ranging from about 1 to 1,000 mg per $m^2$, and preferably from 5 to 200 mg per $m^2$, of the photographic light-sensitive material.

Incorporation of these surface active agents into the photographic light-sensitive layers can be carried out by dissolving them in water or organic solvents, e.g., methanol, ethanol, acetone, etc., or mixed solvents of these organic solvents and water, and then incorporating the solution in light-sensitive emulsion layers or light-insensitive auxiliary layers, such as a backing layer, an anti-halation layer, an intermediate layer, a protecting layer, etc., that are provided on a support, or spraying or coating the solution on a support, or dipping a support in the solution, followed by drying.

Also, mixtures of two or more of each the nonionic surface active agents and the anionic surface active agents can be used.

A further enhanced effect to prevent antistatic charge can be attained by incorporating other antistatic agents in the layer containing the nonionic surface active agent and the anionic surface active agent according to the present invention or other layers. Such antistatic agents preferably include fluorine-containing surface active agents having a polyoxyethylene group in their molecule.

The fluorine-containing surface active agents having a polyoxyethylene group that can be used in combination are represented by the formula (III):

$$R_f—A—CH_2CH_2O)_{n6}B—E \qquad (III)$$

wherein $R_f$ represents a substituted or unsubstituted alkyl group having 1 to 30 carbon atoms, a substituted or unsubstituted alkenyl group having from 2 to 30 carbon atoms or a substituted or unsubstituted aryl group having 6 to 30 carbon atoms, a part or the whole of the carbon atoms thereof being substituted with fluorine atoms; A and B are as defined for Compound (II) above; E represents a watersoluble group; and $n_6$ represents an average degree of polymerization of the ethylene oxide moiety ranging from 1 to 50.

In the above-described formula (III), $R_f$ preferably represents an alkyl group having from 4 to 15 carbon atoms or an alkylaryl group having from 7 to 15 carbon atoms. More preferably, $R_f$ represents $$H(CF_2)_{n7}CH_2—,\ C_{n8}F_{2n8+1}(CH_2)_{n9}—,\ C_9F_{19}C_6H_4—,$$

etc., wherein $n_7$ and $n_8$ each represents an integer of 4 to 12; and $n_9$ represents 0 or an integer of 1 to 4. $n_6$ preferably represents an integer of from 2 to 10. E preferably represents $$—COOM,\ —SO_3M,\ —OSO_3M,\ —O—P(=O)(OM)_2,\ —\overset{\oplus}{N}(R_{11})_3.X^{\ominus},$$
$$—\overset{\oplus}{N}(R_{11})—CH_2COO^{\ominus},\ —\overset{\oplus}{N}(R_{11})(CH_2)_{14}SO_3^{\ominus},\ —OH,$$

etc., wherein M and $R_{11}$ are as defined above, and X represents an anion.

Examples of such compounds represented by formula (III) are given in British Patent Nos. 1,293,189 and 1,259,398, *I & EC Product Research and Development*, Vol. 1 (3), pp 165–169 (1962), Yukagaku, Vol. 12 (12), pp 653–663 (1963), Japanese Patent Application (OPI) Nos. 32322/76, 151125/76, 7762/80, etc. Particularly preferred fluorine-containing surface active agents are anionic surface active agents.

Specific examples of the fluorine-containing surface active agents that can be used in the present invention are shown below.

| Compound No. | Chemical Formula |
|---|---|
| III-1 | $C_7F_{15}CON(C_3H_7)(CH_2CH_2O)_2(CH_2)_3SO_3Na$ |
| III-2 | $C_6F_{13}SO_2N(CH_3)(CH_2CH_2O)_3(CH_2)_4SO_3Na$ |
| III-3 | $C_8H_{17}SO_2—N(C_3H_7)(CH_2CH_2O)_4(CH_2)_4SO_3K$ |
| III-4 | $C_8F_{17}SO_2—N(C_3H_7)(CH_2CH_2O)_6(CH_2)_4SO_3Na$ |
| III-5 | $C_9F_{17}O$–C$_6$H$_4$–$SO_2N(C_3H_7)(CH_2CH_2O)_5(CH_2)_4SO_3K$ |
| III-6 | $C_6F_{13}SO_2N(C_3H_7)(CH_2CH_2O)_2C(=O)—CH$ <br> $C_6F_{13}SO_2N(C_3H_7)(CH_2CH_2O)_2C(=O)—CH_2—SO_3Na$ |
| III-7 | $C_8F_{17}(CH_2CH_2O)_5(CH_2)_4SO_3Na$ |
| III-8 | $H(CF_2)_8CH_2O(CH_2CH_2O)_4(CH_2)_3SO_3H$ |
| III-9 | $C_7F_{15}COO(CH_2CH_2O)_4(CH_2)_4SO_3K$ |
| III-10 | $C_8F_{17}SO_2N(CH_3)(CH_2CH_2O)_8SO_3Na$ |

-continued

| Compound No. | Chemical Formula |
|---|---|
| III-11 | $C_4F_9(CH_2CH_2O)_7SO_3Na$ |
| III-12 | $C_7F_{15}CON(C_3H_7)(CH_2CH_2O)_5SO_3H$ |
| III-13 | $C_8F_{17}SO_2N(C_3H_7)(CH_2CH_2O)_6CH_2COONa$ |
| III-14 | $H(CF_2)_8CH_2O(CH_2CH_2O)_3P(=O)(ONH_4)(ONH_4)$ |
| III-15 | $C_8F_{17}SO_2N(C_3H_7)(CH_2CH_2O)_4P(=O)(ONa)(ONa)$ |
| III-16 | $C_8F_{17}SO_2N(C_3H_7)(CH_2CH_2O)_4CH_2CH_2\overset{\oplus}{N}(CH_3)_3.CH_3-C_6H_4-SO_3^{\ominus}$ |
| III-17 | $C_8F_{17}SO_2N(C_3H_7)(CH_2CH_2O)_4CH_2CH_2-\overset{\oplus}{N}(CH_3)(CH_3)-CH_2COO^{\ominus}$ |
| III-18 | $C_8F_{17}(CH_2CH_2O)_3CH_2CH_2-N(CH_3)-CH_2COO^{\ominus}$ |
| III-19 | $C_8H_{17}SO_2N(C_3H_7)(CH_2CH_2O)_8H$ |
| III-20 | $C_8F_{17}(CH_2CH_2O)_{12}-H$ |
| III-21 | $H(CF_2)_{10}-CH_2O(CH_2CH_2O)_{15}-H$ |

The amount of the fluorine-containing surface active agent of the formula (III) to be used in the present invention varies depending upon the forms, types or coating methods employed for photographic light-sensitive materials, but usually range from about 0.1 to 1,000 mg, and preferably from 0.5 to 200 mg, per $m^2$ of the photographic light-sensitive materials.

In the present invention, it is also possible to use other known antistatic agents in combination with the surface active agents of the formulae (I-2), (I-3), (II) and (III). Such known antistatic agents include, for example, polymers as disclosed in U.S. Pat. Nos. 2,882,157, 2,972,535, 3,062,785, 3,262,807, 3,514,291, 3,615,531, 3,753,716, 3,938,999, 4,070,189 and 4,147,550, German Patent No. 2,800,466, Japanese Patent Application (OPI) Nos. 91165/73, 94433/73, 46733/74, 54672/75, 94053/75 and 129520/77, etc.; surface active agents as disclosed in U.S. Pat. Nos. 2,982,651, 3,428,456, 3,457,076, 3,454,625, 3,552,972 and 3,655,387, etc.; metal oxides colloidal silica as disclosed in U.S. Pat. Nos. 3,062,700, 3,245,833 and 3,525,621, etc.; barium sulfate strontium; polymethyl methacrylate; methyl methacrylate-methacrylic acid copolymers; so-called matting agents comprising colloidal silica or powderous silica and the like.

The photographic layers containing the nonionic surface active agent and the anionic active agent of this invention or other layers of the photographic light-sensitive material may also contain a polyol compound as described in Japanese Patent Application (OPI) No. 89626/79, such as ethylene glycol, propylene glycol, 1,1,1-trimethylolpropane, etc., thereby to obtain a further heightened effect to prevent static charge.

Layers to which the nonionic surface active agent and the anionic surface active agent are incorporated according to the present invention include emulsion layers, other layers provided on the same side of the emulsion layers, such as a subbing layer, an intermediate layer, a surface protecting layer and an overcoat layer, and layers provided on the opposite side to the emulsion layers, such as backing layer. Of these, a surface protecting layer, an overcoat layer and a backing layer are preferred.

Support bases to be used in the photographic light-sensitive materials of this invention include films made of polyolefins (e.g., polyethylene), polystyrene, cellulose derivatives (e.g., cellulose triacetate), cellulose esters (e.g., polyethylene terephthalate), etc., baryta paper; synthetic paper or paper laminated with these polymer films on both sides thereof; and the like.

The support base to be used in the present invention may be provided with an anti-halation layer. For this purpose, carbon black or various dyes such as oxol dyes, azo dyes, arylidene dyes, styryl dyes, anthraquinone dyes, merocyanine dyes and tri- or di-allylmethane dyes can be used.

The light-sensitive materials in accordance with the present invention can include ordinary black-and-white silver halide photographic light-sensitive materials (e.g., black-and-white light-sensitive materials for black-and-white photography, X-ray imaging, printing, etc.), ordinary multilayer color photographic light-sensitive materials (e.g., color reversal films, color negative films, color positive films, etc.), and various other light-sensitive materials. In particular, silver halide light-sensitive materials intended for high temperature rapid processing and high sensitivity silver halide light-sensitive materials can be provided with a remarkable antistatic effect by the present invention.

The silver halide photographic light-sensitive materials according to the present invention are further described hereinafter.

Binders used in photographic emulsion layers include proteins, e.g., gelatin and casein; cellulose derivatives, e.g., carboxymethyl cellulose and hydroxyethyl cellulose; sugar derivatives, e.g., agar, sodium alginate and starch derivatives; synthetic hydrophilic colloids, e.g., polyvinyl alcohol, poly-N-vinylpyrrolidone, polyacrylic acid copolymers, polyacrylamide or derivatives or partial hydrolysates thereof; and the like.

Gelatin that can be used herein includes the so-called lime-processed gelatin, acid-processed gelatin, and enzyme-processed gelatin.

In the photographic light-sensitive materials according to the present invention, there are no particular limitations on the kind of silver halides used in silver halide emulsion layers or surface protecting layers, processes for producing the same, processes for chemical sensitization, the kinds of antifoggants, stabilizers, hardeners, antistatic agents, plasticizers, lubricants, coating assistants, matting agents, whiteness, spectral sensitizers, dyes, couplers, and the like. For example, reference can be made to descriptions in *Product Licens-*

*ing,* Vol. 92, 107–110 (December, 1971), and *Research Disclosure,* Vol. 176, 22–31 (December, 1978).

More specifically, antifoggants and stabilizers include a wide variety of compounds such as 4-hydroxy-6-methyl-1,3,3a,7-tetrazaindene-3-methyl-benzothiazole and 1-phenyl-5-mercaptotetrazole as well as many heterocyclic compounds, mercury-containing compounds, mercapto compounds, metal salts, and the like.

Examples of the hardeners include aldehyde type compounds, e.g., mucochloric acid, mucobromic acid, mucophenoxychloric acid, mucophenoxybromic acid, formaldehyde, dimethylolurea, trimethylolmelamine, glyoxal, monomethylglyoxal, 2,3-dihydroxy-1,4-dioxane, 2,3-dihydroxy-5-methyl-1,4-dioxane, succinaldehyde, 2,5-dimethoxytetrahydrofuran, glutaraldehyde, etc.; active vinyl type compounds, e.g., divinylsulfone, methylenebismaleimide, 5-acetyl-1,3-diacryloylhexahydro-s-triazine, 1,3,5-triacryloyl-hexahydro-s-triazine, 1,3,5-trivinylsulfonyl-hexahydro-s-triazinebis(vinylsulfonylmethyl)ether, 1,3-bis(vinylsulfonylmethyl)-propanol-2, bis($\alpha$-vinylsulfonylacetamido)ethane, etc.; active halogen type compounds, e.g., sodium 2,4-dichloro-6-hydroxy-s-triazine, 2,4-dichloro-6-methoxy-s-triazine, sodium 2,4-dichloro-6-(4-sulfonanilino)-s-triazine, 2,4-dichloro-6-(2-sulfoethylamino)-s-triazine, N,N'-bis(2-chloroethylcarbamoyl)piperazine, etc.; epoxy type compounds, e.g., bis-(2,3-epoxypropyl)methylpropylammonium p-toluenesulfonate, 1,4-bis(2',3'-epoxypropyloxy)butane, 1,3,5-triglycidylisocyanurate, 1,3-diglycidyl-5-($\gamma$-acetoxy-$\beta$-oxypropyl)isocyanurate, etc.; ethyleneimine type compounds, e.g., 2,4,6-triethyleneimino-s-triazine, 1,6-hexamethylene-N,N'-bisethyleneurea, bis-$\beta$-ethyleneiminoethylthioether, etc.; methanesulfonate type compounds, e.g., 1,2-di(methanesulfonoxy)ethane, 1,4-di(methanesulfonoxy)butane, 1,5-di(methanesulfonoxy)pentane, etc.; carbodiimide type compounds; isoxazole type compounds; and inorganic type compounds, e.g., chromium alum; and the like. Of these hardeners, those compounds having an active vinyl group and the inorganic type compounds are particularly preferred.

The photographic light-sensitive materials of the present invention can further contain known surface active agents in combination with the nonionic surface active agents and anionic surface active agents of this invention in the same layer(s) or different layer(s).

Such known surface active agents include, for example, cationic surface active agents, such as higher alkylamines, quaternary ammonium salts, pyridine and other heterocyclic compounds, phosphoniums or sulfoniums, etc.; anionic surface active agents containing acid radicals, such as a carboxyl group, a sulfonic acid group, a phosphoric acid group, a sulfuric ester group, a phosphoric ester group, etc.; and amphoteric surface active agents, such as amino acids, aminosulfonic acids, sulfuric or phosphoric esters of amino alcohols, etc.

The layers constituting the photographic light-sensitive materials of the present invention can also contain an alkyl acrylate type latex described in U.S. Pat. Nos. 3,411,911 and 3,411,912, Japanese Patent Publication No. 5331/70, etc.

Silver halide groups in the photographic emulsions may have a regular crystal form such as that of a cube, an octahedron, etc., an irregular crystal form such as a spherical form, a plate form, etc.; or a composite form thereof. The silver halide grains may also be a mixture of grains having various crystal forms.

The above-described photographic emulsions can be prepared according to conventional methods as disclosed in P. Glafkides, *Chimie et Physique Photographique,* Paul Montel, Paris (1967), G. F. Duffin, *Photographic Emulsion Chemistry,* The Focal Press, London (1964), and so on.

Typically, the silver halide emulsion is chemically sensitized. Chemical sensitization can be carried out by processes as described in the aforesaid literatures written by Glafkides or Zelikman et al. and H. Frieser (ed.), *Die Grundlagen der Photographischen Prozesse mit Silberhalogeniden,* Akademische Verlagsgesellschaft (1968).

More specifically, chemical sensitization can be effected by sulfur sensitization using compounds containing sulfur capable of reacting with silver ions (e.g., thiosulfates, thioureas, thiazoles, rhodanines, etc.), reduction sensitization using reducing materials (e.g., stannous salts, amines, hydrazine derivatives, formamidinesulfinic acid, silane compounds, etc.), noble metal sensitization using noble metal compounds (e.g., gold complexes and complexes of Periodic Table Group VIII metals such as Pt, Ir, Pd, etc.) and the like either solely or in combination thereof.

The photographic emulsion of the present invention may be spectrally sensitized with methine dyes and the like. Dyes to be used for spectral sensitization include cyanine dyes, merocyanine dyes, composite cyanine dyes, composite merocyanine dyes, holopolar cyanine dyes, hemicyanine dyes, styryl dyes, and hemioxonol dyes, with cyanine dyes, merocyanine dyes, and composite merocyanine dyes being preferred.

The present invention will now be illustrated in greater detail with reference to specific examples, but it should be understood that the present invention is not limited thereto.

EXAMPLE 1

(1) Preparation of Samples

A silver halide emulsion having the following composition was coated on a polyethylene terephthalate film support having a thickness of 180 $\mu$m and having been subjected to subbing treatment to a thickness of about 5 $\mu$m, and a protecting layer having the following composition was further coated thereon to a thickness of about 1 $\mu$m, followed by drying to prepare a black-and-white silver halide light-sensitive material. The protecting layer contained the nonionic surface active agent of the formula (I-2) according to the present invention and the anionic surface active agent of the formula (II) according to the present invention or, for comparison, Comparative Anionic Surface Active Agent (a) or (b), as indicated in Table 1.

| Component | Coated Amount |
|---|---|
| Emulsion Layer: | |
| Gelatin | 2.5 g/m$^2$ |
| Silver iodobromide (silver iodide: 1.5 mol %) | 5 g/m$^2$ |
| 1-Phenyl-5-mercaptotetrazole | 25 mg/m$^2$ |
| Protecting Layer: | |
| Gelatin | 1.7 g/m$^2$ |
| Sodium 2,6-dichloro-6-hydroxy-1,3,5-triazine | 10 mg/m$^2$ |
| Nonionic surface active agent (shown in Table 1) | 60 mg/m$^2$ |
| Anionic surface active agent (shown in Table 1) | 25–40 mg/m$^2$ |

(2) Evaluation of Antistatic Property

The antistatic property was evaluated by measuring the surface resistance and occurrence of static marks as follows:

The surface resistance was determined by interposing a sample piece between brass electrodes spaced at a distance of 0.14 cm and each having a length of 10 cm (the portions in contact with the sample piece were made of stainless steel) and measuring the 1 minute value using an insulation resistance tester, TR 8651 model manufactured by Takeda Riken K.K.

In the test of occurrence of static marks, static marks were formed by pressing an unexposed light-sensitive material onto a rubber sheet with the antistatic agent-containing side of the light-sensitive material facing downward by the use of a press roll, followed by peeling off the light-sensitive material.

The measurement of the surface resistance and the occurrence of static marks were conducted at 25° C. and 25% RH. Air conditioning for the sample piece was continued over 24 hours under the above-described temperature and humidity conditions.

Each sample was developed with a developer having the following composition at 20° C. for 5 minutes.

| Developer: | |
|---|---|
| Component | Amount |
| N—Methyl-p-aminophenol sulfate | 4 g |
| Anhydrous sodium sulfite | 60 g |
| Hydroquinone | 10 g |
| Sodium carbonate monohydrate | 53 g |
| Potassium bromide | 25 g |
| Water to make | 1 liter |

The scale employed for the evaluation of static marks was as follows:

A: No occurrence of static marks was observed.
B: Slight occurrence of static marks was observed.
C: Considerable occurrence of static marks was observed.
D: Very extensive occurrence of static marks was observed.
E: Static marks were formed on the entire surface.

(3) Evaluation of Photographic Properties

Each of the above-described samples was exposed to light using a tungsten lamp through a filter, SP-14 manufactured by Fuji Photo Film Co., Ltd., and the exposed film was developed with a developer having the following composition at 35° C. for 30 seconds, fixed and rinsed. The thus processed samples were evaluated for photographic sensitivity.

| Developer: | |
|---|---|
| Component | Amount |
| Warm water | 800 ml |
| Sodium tetrapolyphosphate | 2.0 g |
| Anhydrous sodium sulfite | 50 g |
| Hydroquinone | 10 g |
| Sodium carbonate monohydrate | 40 g |
| 1-Phenyl-3-pyrazolidone | 0.3 g |
| Potassium bromide | 2.0 g |
| Water to make | 1 liter |

(4) Evaluation of Roller Contamination

A sample having coated thereon an emulsion layer and a surface protecting layer was cut into pieces of 30.5 cm×17.1 cm and uniformly exposed to light so as to have an optical density of 1.0 after the subsequent development processing. Fifteen sample pieces were continuously developed and processed using an automatic developing machine having a silicon roller carrying means and comprising a developer (RD-II made by Fuji Photo Film. Co., Ltd., at 35° C.), a fixing bath (Fuji-F made by Fuji Photo Film Co., Ltd., at 35° C. ) and a rinsing bath. After the rinsing squeeze rollers were thoroughly dried, a 51st sample film was passed through the developing machine, and the stripe-like unevenness of density appearing in the head part of the film was examined to evaluate contamination of rollers.

Evaluation of roller contamination was in accordance with the following scale:

A: No unevenness in density was observed.
B: Slight unevenness in density was observed.
C: Considerable unevenness in density was observed.
D: Very extensive unevenness in density was observed.

The results obtained in the above-described tests (1) to (4) are shown in Table 1.

As is obvious from Table 1, it can be seen that the photographic light-sensitive materials containing the non-ionic surface active agent and anionic surface active agent according to the present invention satisfy all the requirements with respect to static mark, photographic sensitivity, and roller contamination.

TABLE 1

| Sample No. | Nonionic Surface Active Agent | Anionic Surface Active Agent (Amount Added; mg/m$^2$) | Antistatic Properties: Surface Resistance (Ω) | Antistatic Properties: Static Mark | Photographic Sensitivity (Relative value) | Roller Contamination |
|---|---|---|---|---|---|---|
| 1 | I-1 | II-2 (40) | $4.1 \times 10^{11}$ | B | 97 | A |
| 2 | I-2 | II-5 (25) | $4.9 \times 10^{11}$ | A | 98 | A |
| 3 | A*** | (a)* (25) | $5.7 \times 10^{11}$ | A | 98 | D |
| 4 | I-2 | (b)** (30) | $6.2 \times 10^{11}$ | B | 97 | D |

TABLE 1-continued

| Sample No. | Nonionic Surface Active Agent | Anionic Surface Active Agent (Amount Added; mg/m²) | Antistatic Properties Surface Resistance (Ω) | Antistatic Properties Static Mark | Photographic Sensitivity (Relative value) | Roller Contamination |
|---|---|---|---|---|---|---|
| (blank) | — | — | $7.3 \times 10^{14}$ | E | 100 | A |

Note:
*Comparative Anionic Surface Active Agent (a):

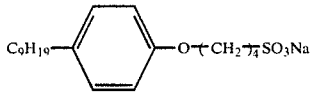

(Japansene Patent Application (OPI) No. 29715/78)
**Comparative Anion Surface Active Agent (b):

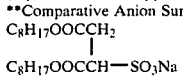

(Japanese Patent Publication No. 9610/76)
***Comparative Nonionic Surface Active Agent

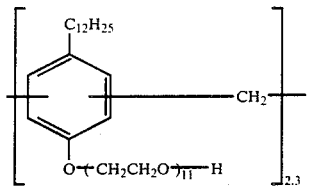

EXAMPLE 2

The same procedures as described in Example 1 were repeated, using the nonionic surface active agent of the formula (I-3), the anionic surface active agent of the formula (II), or Comparative Surface Active Agent (a) or (b) (the same as those used in Example 1) as indicated in Table 2. The results are shown in Table 2.

As is obvious from Table 2, it can be seen that the photographic light-sensitive materials containing the nonionic surface active agent and anionic surface active agent according to the present invention undergo little static mark generation, exhibit excellent photographic sensitivity, and show significant improvements in reduction of roller contamination.

The resulting samples were tested for surface resistance, static mark, photographic property (i.e., sensitivity) and roller contamination in the same manner as in Example 1. Further, contamination of the developer was examined as follows:

A sample having coated thereon an emulsion layer and a surface protecting layer was cut into pieces of 30.5 cm×25.4 cm. After uniform exposure to light so that the optical density after the subsequent development processing became 1.3, 100 sample pieces were continuously developed using an automatic developing machine, RU made by Fuji Photo Film Co., Ltd., comprising a developing bath (RD-III made by Fuji Photo Film Co., Ltd.) at 35° C., a fixing bath (Fuji-F made by Fuji Photo Film Co., Ltd.) at 35° C. and a rinsing bath.

TABLE 2

| Sample No. | Nonionic Surface Active Agent | Anionic Surface Active Agent (Amount Added; mg/m²) | | Antistatic Properties Surface Resistance (Ω) | Antistatic Properties Static Mark | Photographic Sensitivity (Relative value) | Roller Contamination |
|---|---|---|---|---|---|---|---|
| 5 | I-3 | II-13 | (35) | $4.4 \times 10^{11}$ | A | 98 | A |
| 6 | I-5 | II-2 | (30) | $3.0 \times 10^{11}$ | A | 99 | A |
| 7 | I-5 | II-5 | (30) | $2.8 \times 10^{11}$ | A | 99 | A |
| 8 | I-12 | II-7 | (30) | $3.4 \times 10^{11}$ | A | 98 | A |
| 9 | I-21 | II-8 | (35) | $2.2 \times 10^{11}$ | A | 100 | A |
| 10 | I-26 | II-14 | (30) | $4.6 \times 10^{11}$ | A | 99 | A |
| 11 | I-5 | (a) | (35) | $4.5 \times 10^{11}$ | B | 97 | D |
| 12 | I-21 | (b) | (30) | $3.9 \times 10^{11}$ | B | 98 | D |
| (blank) | — | — | | $5.7 \times 10^{14}$ | E | 100 | A |

EXAMPLE 3

Samples were prepared in the same manner as described in Example 1 except for adding the antistatic agent shown in Table 3 to the protecting layer.

The number of spots where the silver halide layer had fallen off was counted on the 100th sample piece to evaluate the extent of contamination of the developer.

These results obtained are shown in Table 3.

TABLE 3

| Sample No. | Nonionic Surface Active Agent | Anionic Surface Active Agent (Amount Added; mg/m²) | | F-Containing Surface Active Agent (Amount Added: mg/m²) | | Antistatic Properties Surface Resistance (Ω) | Antistatic Properties Static Mark | Photographic Sensitivity (Relative value) | Roller Contamination | Number of Stain Spots |
|---|---|---|---|---|---|---|---|---|---|---|
| 13 | I-5 | II-5 | (30) | III-3 | (5) | $7.5 \times 10^{11}$ | A | 98 | A | 0 |
| 14 | I-5 | II-5 | (30) | III-16 | (3) | $8.2 \times 10^{11}$ | A | 100 | A | 1 |
| 15 | I-5 | II-12 | (35) | III-12 | (6) | $9.6 \times 10^{11}$ | B | 99 | A | 2 |

TABLE 3-continued

| Sample No. | Nonionic Surface Active Agent | Anionic Surface Active Agent (Amount Added: mg/m²) | | F-Containing Surface Active Agent (Amount Added: mg/m²) | | Antistatic Properties: Surface Resistance (Ω) | Antistatic Properties: Static Mark | Photographic Sensitivity (Relative value) | Roller Contamination | Number of Stain Spots |
|---|---|---|---|---|---|---|---|---|---|---|
| 16 | I-21 | II-13 | (30) | III-4 | (5) | $7.0 \times 10^{11}$ | A | 97 | A | 0 |
| 17 | I-38 | II-16 | (40) | III-16 | (10) | $5.3 \times 10^{11}$ | A | 98 | B | 1 |
| 18 | I-35 | II-18 | (30) | III-17 | (10) | $1.5 \times 10^{14}$ | B | 100 | B | 3 |
| 19 | I-26 | II-14 | (30) | III-19 | (8) | $9.2 \times 10^{11}$ | A | 96 | B | 1 |

EXAMPLE 4

The following combination of anionic and nonionic surface active agents were tested for occurrence of the static marks with the passage of time while contacting the X-ray film with a paper which is usually inserted between films.

(i) U.S. Pat. No. 3,850,641 (Horigome et al)

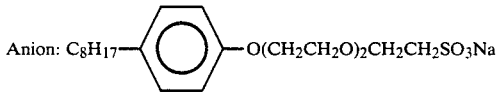

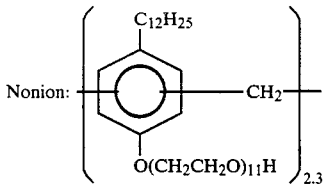

(ii)
U.S. Pat. No. 4,367,283 (Nakayama et al)
Anion: Same anion as used for (i) above
Nonion: $C_{12}H_{25}O(CH_2CH_2O)_{10}H$ (iii)
Present Invention
Anion: Same anion as in (i) above
Nonion: Compound I-1

(iv)
Present Invention
Anion: Same anion as in (i) above
Nonion: Compound I-5

(v)
Present invention
Anion: Same anion as in (i) above
Nonion: Compound I-2

A sample film was cut in a size of 4 cm×4 cm and inserted between two pieces of paper generally used for inserting between X-ray films. The resulting laminate was loaded at 1 kg and allowed to stand for 3 days under loading at 25° C. in a sealed condition. Then, the film was tested for occurrence of static marks according to the procedure for evaluation of antistatic property as described in Example 1. The results obtained are shown in Table 4 below wherein the symbols A to E are described below.

TABLE 4

| | Sample | Static Marks: Fresh Film | Static Marks: Film after 3 days (at 1 kg load, 25° C.) |
|---|---|---|---|
| (i) | Sample of Horigome | A | D |
| (ii) | Sample of Nakayama | A | E |
| (iii) | Sample of Invention | A | B |
| (iv) | Sample of Invention | A | A |

TABLE 4-continued

| | Sample | Static Marks: Fresh Film | Static Marks: Film after 3 days (at 1 kg load, 25° C.) |
|---|---|---|---|
| (v) | Sample of Invention | A | B |

The scale used for evaluating static marks in the above table was as follows:

A: No occurrence of static marks was observed.
B: Slight occurrence of static marks was observed.
C: Considerable occurrence of static marks was observed.
D: Very extensive occurrence of static marks was observed.
E: Static marks were observed on the entire surface.

The above results show that the present invention provides superior results with respect to the occurrence of static marks over the passage of time when the film was contacted with paper.

When the antistatic property of X-ray films decreases with the passage of time and, as a result, static marks are liable to occur, such X-ray films may cause a serious problem of incorrent diagnostic judgment in view of the particular utility of the X-ray films. The X-ray films according to the present invention show markedly reduced static marks and are practically advantageous.

The poor results in the occurrence of static marks in Samples (i) and (ii) in the above test are believed due to diffusion of nonionic surface active agent into the paper during the storage of film.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive element comprising a support having provided thereon at least one silver halide emulsion layer, said element containing in one or more of a silver halide emulsion layer, a subbing layer, an intermediate layer, a surface protecting layer, an overcoat layer or a backing layer:

(A) from about 1 to 1,000 mg per m² of the photographic light-sensitive material of at lease one nonionic surface active agent represented by formula (I-3):

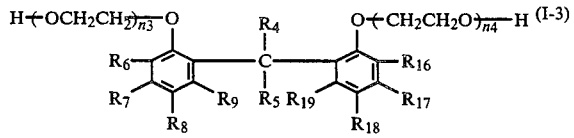

wherein $R_4$ and $R_5$ each represents a hydrogen atom, a substituted or unsubstituted alkyl group having from 1 to 30 carbon atoms or a substituted or unsubstituted aryl group having from 7 to 30 carbon atoms, or $R_4$ and $R_5$ together form a substituted or unsubstituted ring; $R_6$, $R_8$, $R_{16}$, and $R_{18}$ each represents a substituted or unsubstituted alkyl group having from 1 to 30 carbon atoms, a substituted or unsubstituted aryl group having from 6 to 30 carbon atoms, or a substituted or unsubstituted alkoxy group having from 1 to 30 carbon atoms, a halogen atom, an acyl group, an amido group, a sulfonamido group, a carbamoyl group, or a sulfamoyl group; $R_7$, $R_9$, $R_{17}$ and $R_{19}$ each represents a hydrogen atom, a substituted or unsubstituted alkyl group having from 1 to 30 carbon atoms, a substituted or unsubstituted aryl group having from 6 to 30 carbon atoms, or a substituted or unsubstituted alkoxy group having from 1 to 30 carbon atoms, a halogen atom, an acyl group, an amido group, a sulfonamido group, a carbamoyl group, or a sulfamoyl group; or $R_6$ and $R_7$, $R_8$ and $R_9$, $R_{16}$ and $R_{17}$, or $R_{18}$ and $R_{19}$ together form a substituted or unsubstituted ring; and $n_3$ and $n_4$, which may be the same or different, each represents an average degree of polymerization of the ethylene oxide moiety ranging from 2 to 50; and (B) from about 1 to 1,000 mg per $m^2$ of the photographic light-sensitive material of at least one anionic surface active agent represented by formula (II):

$$R_1—A—CH_2CH_2O)_{n5}B—D \qquad (II)$$

wherein $R_1$ represents a substituted or unsubstituted alkyl group having from 1 to 30 carbon atoms, a substituted or unsubstituted alkenyl group having from 2 to 30 carbon atoms or a substituted or unsubstituted aryl group having, from 6 to 30 carbon atoms; A represents $$—O—,\ —S—,\ —COO—,\ —\underset{|}{N}—R_{10},\ —CO—\underset{|}{N}—R_{10} \text{ or } —SO_2\underset{|}{N}—R_{10},$$

wherein $R_{10}$ represents a hydrogen atom or a substituted or unsubstituted alkyl group having from 1 to 30 carbon atoms; B represents a substituted or unsubstituted alkyl group having from 1 to 30 carbon atoms, a substituted or unsubstituted alkenyl group having from 2 to 30 carbon atoms or a substituted or unsubstituted aryl group having from 6 to 30 carbon atoms; D represents an anion group; and $n_5$ represents an average degree of polymerization ranging from 1 to 50.

2. A silver halide photographic light-sensitive element as claimed in claim 1, wherein $R_7$ and $R_9$ each represents a hydrogen atom, a substituted or unsubstituted alkyl group having from 1 to 20 carbon atoms, a substituted or unsubstituted aryl group, a substituted or unsubstituted alkoxy group of the formula $—OR_{11}$ wherein $R_{11}$ represents a substituted or unsubstituted alkyl group having from 1 to 20 carbon atoms or a substituted or unsubstituted aryl group, a halogen atom, an acyl group of the formula $—COR_{11}$, an amido group of the formula $—NR_{12}COR_{11}$, wherein $R_{12}$ represents a hydrogen atom or an alkyl group having from 1 to 20 carbon atoms, a sulfonamido group of the formula $—NR_{12}SO_2R_{11}$, a carbamoyl group of the formula $$—CON\begin{matrix}R_{12}\\R_{12}\end{matrix},$$

or a sulfamoyl group of the formula $$—SO_2N\begin{matrix}R_{12}\\R_{12}\end{matrix};$$

$R_6$ and $R_8$ each represents a substituted or unsubstituted alkyl group having 1 to 20 carbon atoms, a substituted or unsubstituted aryl group, a substituted or unsubstituted alkoxy group of the formula $—OR_{11}$, a halogen atom, an acyl group of the formula $—COR_{11}$, an amido group of the formula $—NR_{12}COR_{11}$, a sulfonamido group of the formula $—NR_{12}SO_{12}R_{11}$, a carbamoyl group of the formula $$—CON\begin{matrix}R_{12}\\R_{12}\end{matrix},$$

or a sulfamoyl group of the formula $$—SO_2N\begin{matrix}R_{12}\\R_{12}\end{matrix};$$

$R_4$ and $R_5$ each represents a hydrogen atom, a substituted or unsubstituted alkyl group having from 1 to 30 carbon atoms or a substituted or unsubstituted aryl group having from 6 to 30 carbon atoms; and $n_3$ and $n_4$ each represents a number of from 5 to 30.

3. A silver halide photographic light-sensitive element as claimed in claim 1, wherein $R_6$ and $R_8$ each represents a t-butyl group, a t-amyl group, or a t-octyl group; $R_7$ and $R_9$ each represents a hydrogen atom; and $R_4$ and $R_5$ each represents a hydrogen atom; an alkyl group having from 1 to 8 carbon atoms, a phenyl group or a furyl group.

4. A silver halide photographic light-sensitive element as claimed in claim 1, wherein $R_1$ represents an alkyl group having from 4 to 24 carbon atoms, an alkenyl group having from 4 to 24 carbon atoms or an alkylaryl group having from 7 to 24 carbon atoms; B represents an alkylene group having from 1 to 6 carbon atoms; D represents $$—COOM,\ —SO_3M,\ —O—SO_3M,\ —O—\overset{\overset{O}{\|}}{\underset{\underset{O}{\|}}{P}}—OM, \text{ or}$$

$$—O—\overset{\overset{O}{\|}}{\underset{\underset{O}{\|}}{P}}—O—B\left(OCH_2OCH_2\right)_{n5}—A—R_1,$$

wherein M represents an organic or inorganic cation; and $n_5$ represents a number of from 2 to 10.

5. A silver halide photographic light-sensitive element as claimed in claim 1, wherein $R_1$ represents a hexyl group, a dodecyl group, an isostearyl group, an oleyl group, a t-butylphenyl group, a 2,4-di-t-butylphenyl group, a 2,4-di-t-pentylphenyl group, a p-dodecylphenyl group, a m-pentadecaphenyl group, a t-octylphenyl group, a 2,4-dinonylphenyl group, or an octylnapthyl group; B represents a methylene group, an ethylene group, a propylene group, or a butylene group; and M represents a hydrogen atom, an alkali metal, an alkaline earth metal, an ammonium group, or a lower alkyl amino group.

6. A silver halide photographic light-sensitive element as claimed in claim 1, wherein said silver halide emulsion layer, subbing layer, intermediate layer, surface protecting layer, overcoat layer or backing layer which contains at least one of said nonionic surface active agent and at least one of said anionic surface active agent further contains a fluorine-containing surface active agent.

7. A silver halide photographic light-sensitive element as claimed in claim 6, wherein said fluorine-containing surface active agent is represented by formula (III):

$$R_f\text{—A—}(CH_2CH_2O)_{n_6}\text{B—E} \qquad \text{(III)}$$

wherein $R_f$ represents a substituted or unsubstituted alkyl group having from 1 to 30 carbon atoms, a substituted or unsubstituted alkenyl group having from 2 to 30 carbon atoms or a substituted or unsubstituted aryl group having from 6 to 30 carbon atoms, a part or the whole of the carbon atoms of which is substituted by fluorine atoms; A represents $$\text{—O—, —S—, —COO—, —}\underset{|}{\text{N}}\text{—}R_{10}\text{, —CO—}\underset{|}{\text{N}}\text{—}R_{10}\text{ or } \text{—SO}_2\underset{|}{\text{N}}\text{—}R_{10},$$

wherein $R_{10}$ represents a hydrogen atom or a substituted or unsubstituted alkyl group having from 1 to 30 carbon atoms; B represents a substituted or unsubstituted alkylene group having from 1 to 30 carbon atoms or a substituted or unsubstituted aryl group having from 6 to 30 carbon atoms; E represents a water-soluble group; and $n_6$ represents an average degree of polymerization of the ethylene oxide moiety ranging from 1 to 50.

8. A silver halide photographic light-sensitive element as claimed in claim 1, wherein said nonionic surface active agent and anionic surface active agent are present in an amount of from 5 to 200 mg per $m^2$ of the photographic light-sensitive material.

9. A silver halide photographic light-sensitive element as claimed in claim 8, wherein $R_f$ represents $$H\text{—}(CF_2)_{n_7}\text{—}CH_2\text{—},\ C_{n_8}F_{2n_8+1}\text{—}(CH_2)_{n_9}\text{—} \text{ or } C_9F_{19}\text{—}C_6H_4\text{—},$$

wherein $n_7$ and $n_8$ each represents an integer of from 4 to 12; $n_9$ represents 0 or an integer of from 1 to 4; and M represents a hydrogen atom, an alkali metal, an alkaline earth metal, an ammonium group, or a lower alkylamino group.

10. A silver halide photographic light-sensitive element as claimed in claim 9, wherein $R_f$ represents a substituted or unsubstituted alkyl group having 4 to 15 carbon atoms or a substituted or unsubstituted alkylaryl group having 7 to 14 carbon atoms, a part or the whole of the carbon atoms thereof being substituted with fluorine atoms; E represents $$\text{—COOM, —SO}_3\text{M, —OSO}_3\text{M, —O—P}(=\text{O})\text{(OM)}_2\text{, —}\overset{\oplus}{\text{N}}(R_{11})_3.X^{\ominus},$$
$$\text{—}\overset{\oplus}{\text{N}}(R_{11})\text{—CH}_2\text{COO}^{\ominus}\text{, —}\overset{\oplus}{\text{N}}(R_{11})\text{—}(CH_2)_4\text{SO}_3^{\ominus} \text{ or OH}^{\ominus},$$

wherein $R_{11}$ represents a substituted or unsubstituted alkyl group or a substituted or unsubstituted aryl group, and M represents an organic or inorganic anion; and $n_6$ represents an integer of from 2 to 10.

11. A silver halide photographic light-sensitive element as claimed in claim 10, wherein said fluorine-containing surface active agent is present in an amount of from about 0.1 to 1,000 mg per $m^2$ of the photographic light-sensitive material.

12. A silver halide photographic light-sensitive element as claimed in claim 11, wherein said fluorine-containing surface active agent is present in an amount of from 0.5 to 200 mg per $m^2$ of the photographic light-sensitive material.

* * * * *